US006341700B1

(12) United States Patent
Söderström

(10) Patent No.: US 6,341,700 B1
(45) Date of Patent: Jan. 29, 2002

(54) DEVICE FOR SORTING DOCUMENTS

(75) Inventor: Sven-Eric Söderström, Enköping (SE)

(73) Assignee: Northport Manufacturing Inc., St. Paul, MN (US)

( * ) Notice: Subject to any disclaimer, the term of this patent is extended or adjusted under 35 U.S.C. 154(b) by 0 days.

(21) Appl. No.: 09/272,386

(22) Filed: Mar. 19, 1999

Related U.S. Application Data

(63) Continuation of application No. PCT/SE97/01812, filed on Oct. 29, 1997.

(51) Int. Cl.[7] ..... B07C 7/04
(52) U.S. Cl. ..... 209/703
(58) Field of Search ..... 209/702, 703, 209/900, 942; 211/10, 50

(56) References Cited

U.S. PATENT DOCUMENTS

| | | | | |
|---|---|---|---|---|
| 721,950 | A | | 3/1903 | Heald |
| 1,030,317 | A | | 6/1912 | Middaugh |
| 1,035,869 | A | * | 8/1912 | Field |
| 1,135,038 | A | * | 4/1915 | Middaugh |
| 1,199,524 | A | * | 9/1916 | Bourn |
| 1,217,973 | A | | 3/1917 | Mann |
| 1,255,940 | A | * | 2/1918 | Smith |
| 1,593,326 | A | | 7/1926 | Bourn |
| 1,698,946 | A | | 1/1929 | Edgren |
| 2,331,175 | A | * | 10/1943 | Connor et al. ..... 129/16.1 |
| 2,570,636 | A | | 10/1951 | Bolling |
| 2,742,161 | A | * | 4/1956 | Nuttall ..... 211/11 |
| 2,884,139 | A | * | 4/1959 | Dunham ..... 211/184 |
| 3,554,429 | A | * | 1/1971 | Cohen ..... 229/15 |
| 4,254,875 | A | | 3/1981 | Varhelyi |
| 4,484,685 | A | | 11/1984 | Williams |
| 4,732,279 | A | | 3/1988 | Gurkin |
| 5,810,182 | A | * | 9/1998 | Levin ..... 211/195 |

* cited by examiner

*Primary Examiner*—Donald P. Walsh
(74) *Attorney, Agent, or Firm*—Fulbright & Jaworski L.L.P.

(57) ABSTRACT

A device for sorting documents having compartments arranged substantially parallel and vertical in a frame in which compartment documents are placed standing up, said compartments having a bottom support structure on which the documents rest, said bottom support structure being displaceable in relation to the partitions between a first position and a second position, in the first position said bottom support structure supporting the documents in a generally upright manner, and in the second position said bottom support structure supporting the documents in a generally horizontal stacked manner, said documents engaging the partitions to provide a controlled fall movement of the documents as the bottom support structure is extended from the first position to the second position, said controlled movement resulting in the documents being provided in a generally horizontal stacked relationship.

17 Claims, 3 Drawing Sheets

DEVICE FOR SORTING DOCUMENTS

This is a continuation of copending international application PCT/SE97/01812 filed Oct. 29, 1997, which designates the United States.

The present invention relates to a device for sorting documents, mail and the like, which device is designed for arranging the documents in a bundle with a desired order between the documents, and to accomplish this in a labour-saving way.

In post offices, in mail departments of companies, institutions, government agencies and the like, there is a need for a rational way of handling large quantities of mail, so that the mail may be distributed to the adressec in a labour-saving way.

Conventional sorting cabinets for documents/mail comprise compartments for sorting the documents in a certain order of distribution, e.g. street address or room number. The documents are sorted into the compartments, and are then removed and gathered in bundles for distribution within, for example, a postal district.

The present invention aims at providing a sorting device which facilitates the bundling of the once sorted documents by comprising means for emptying the sorting compartments in such a way as to automatically bundle the documents in the sorting order.

This aim is reached by means of a device for sorting documents in accordance with the appended claims.

Figure 1:
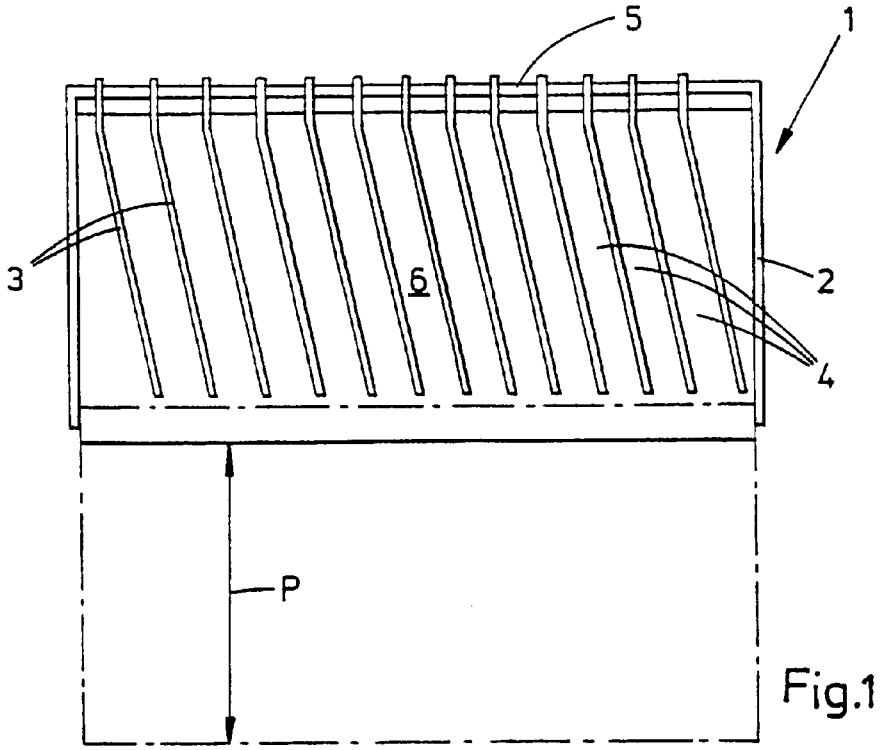
Figure 2:
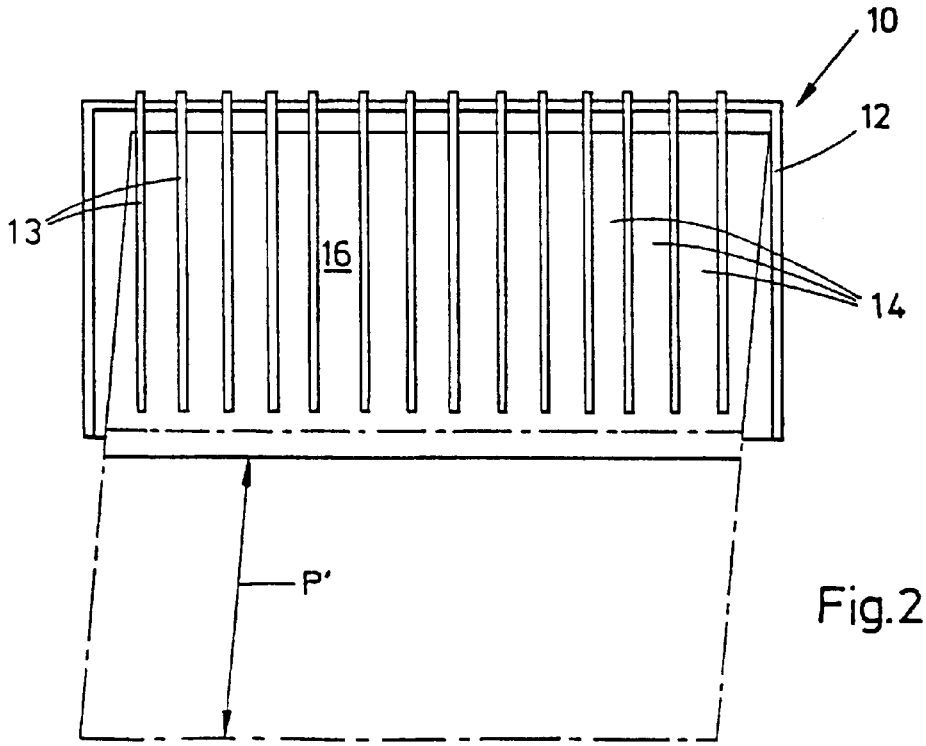
Figure 3:
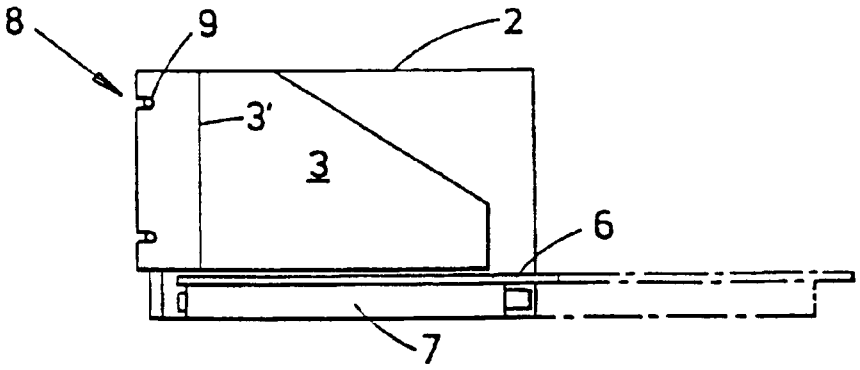
Figure 4:
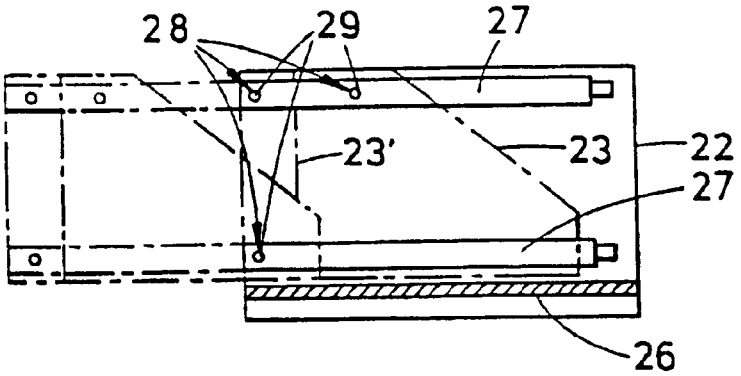
Figure 5:
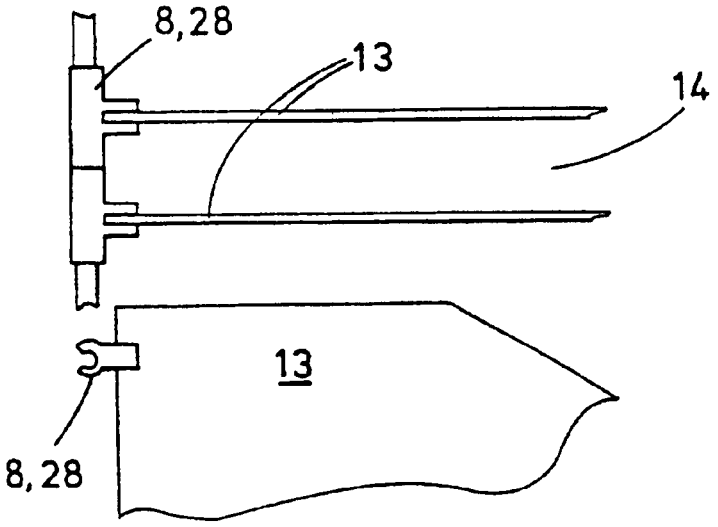
Figure 7:
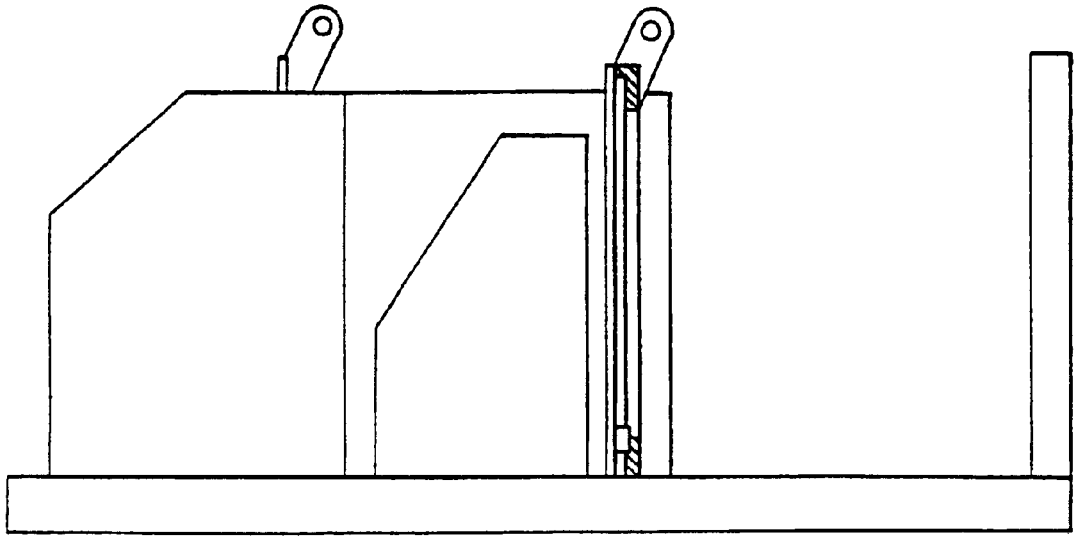
Figure 6:
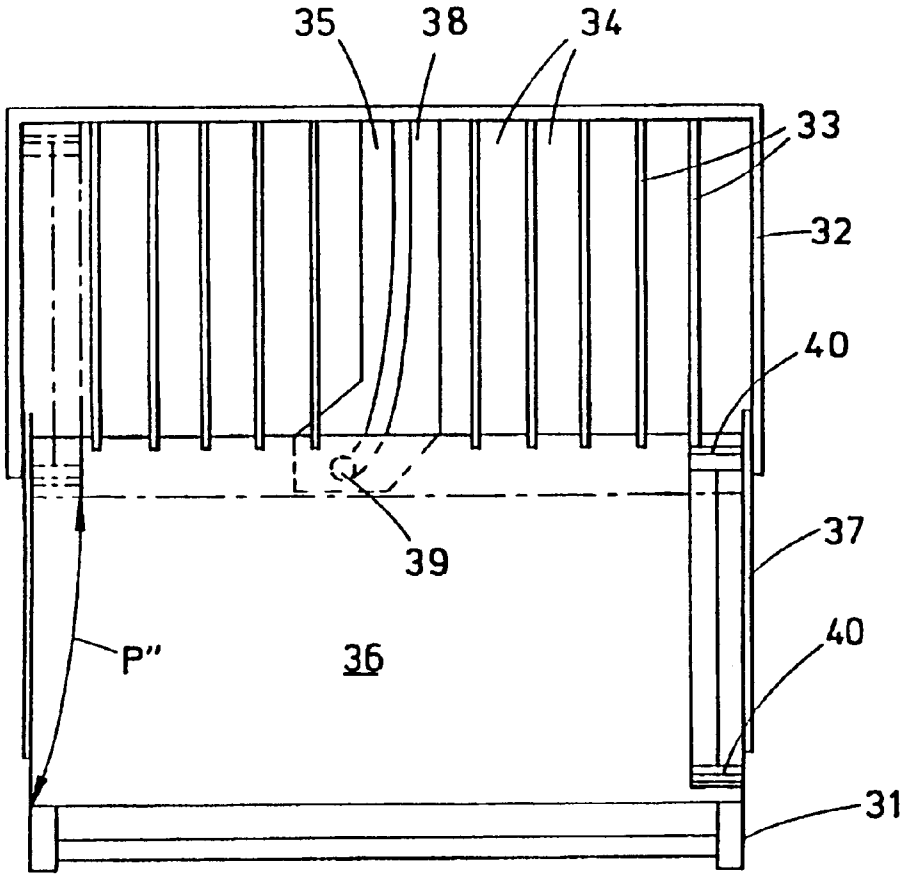

The invention will be more closely described in the following, with reference to the annexed drawings, in which FIG. 1 is a diagrammatical top view of a first embodiment of the sorting device, FIG. 2 is a diagrammatical top view of a second embodiment of the sorting device, FIG. 3 is a diagrammatical sectional view of the first embodiment in FIG. 1, FIG. 4 is a diagrammatical sectional view of a third embodiment of the sorting device, FIG. 5 is a view, partly broken away, of a detail of the invention, FIG. 6 is a diagammatical top plan view of a fourth embodiment of the invention, and FIG. 7 is a diagrammatical side view of two interconnected sorting devices according to any of the disclosed embodiments of the invention.

FIG. 1 shows, in a op plan view, a device for corting documents 1 comprising a frame 2, in which partitions 3 are arranged in a spaced relationship, forming a number of compartments or sorting compartments 4. Said partitions 3 are fixedly or removably arranged on the rear section or rear element 5 connected to the frame 2, said partitions extending substantially parallel with respect to each other. In the first embodiment shown in FIG. 1, the partitions are bent so that, in a horisontal plane, they will extend in an oblique direction with respect to the frame, displaying right angles.

Extending below the partitions 3, spaced apart from their lower edges, is a horisontal plate member which forms the bottom 6 of the sorting compartments 4. Said bottom member 6 is withdrawable from the frame in the direction of arrow P, and displacable with respect to the partitions 3 in a direction P which deviates from the direction in which said partitions extend. The dot-dash line shows the bottom member in a withdrawn or displaced position. Slidable guide means, e.g. guide rails, not illustrated, are arranged in the frame to act as bearing means to allow for the displacement of the bottom member 6.

FIG. 2 shows, in a view similar to that of FIG. 1, a device 10 for sorting documents in accordance with a second embodiment of the invention. Said device 10 has straight partitions 13 extending mainly at right angles in relation to the frame 12, and run parallel with respect to each other, thus forming a number of sorting compartments 14. The partitions 13 are arranged in the frame 12 by suitable means, e.g. as described above, the lower edges of said partitions extending to, although spaced from, a bottom member 16 of the sorting compartments, arranged below said partitions.

The bottom 16 of the sorting compartments is arranged on slidable guiding means (not shown) extending obliquely with respect to the frame 10, in order to, when withdrawn, be displaced in a direction P' which deviates from the general direction in which the partitions 13 extend. The dot-dash line indicates the bottom 16 withdrawn from the frame.

FIG. 3 shows the first embodiment in a diagrammatical sectional view with one of the sides of the frame broken away in order to illustrate the displacable arrangement of the bottom member 6 on slidable guiding means 7, which guiding means are arranged at the lower edge of the side of the frame. In the figure is indicated also the way in which the partitions may be removably arranged in the frame by means of snap-lock means 8 cooperating with rods 9 or the like, which, in turn, are fixedly arranged in the frame 2. Reference numeral 3' indicates a bending line of the partition 3. FIG. 4 is a sectional view, generally corresponding to FIG. 3, differing in that the frame 22, in a third embodiment, has a fixedly arranged bottom member 26. The partition 23 extends, in an horisontal plane, obliquely with respect to the frame 22, said partition displaying, therefore, a bending line 23'. It is appreciated that the oblique orientation of the partition with respect to the frame could be provided for in other ways considered appropriate by the person skilled in the art. The partitions 23 are fixedly or removably arranged, e.g. by means of snap-lock means 28, on rods 29, which, in turn, are directly or indirectly fixed to slidable guiding means 27 fixed to the side the frame. The assembly of partitions 23 is, thus, displacably arranged in the frame 22, for relative movement therewith, and relative the bottom member 26 in a direction which, in a horisontal view, deviates from the general direction in which the partitions extend.

FIG. 5 shows, partly in side view, partly in plan top view, an embodiment of the snap-lock means 8, 28, fixed to the rear edge and the top edge of a partition 13 which is partly broken away. The drawing figure illustrates the way in which the snap-lock member may be used as a spacer for determining the width of the compartments 14. By means of the snapping function, a partition may easily be removed in order to, should the need arise, increase the width of a compartment associated with a certain adressee.

FIG. 6 shows a fourth embodiment 30 of the invention, in which a sorting compartment bottom member 36 is slidably arranged on a carriage means 31, which in turn is slidably supported on guide means, e.g. guiding rails 37 in a frame 32. The frame has removably arranged partitions 33 for forming sorting compartments 34 which extend mainly parallel and at right angles with respect to the frame 32. A bracket 35, which is fixedly arranged in the frame 32, extends under the bottom member 36. Said bracket has a notch 38 which, at least in an outer portion extends in a direction which deviates from the general direction in wich the partitions extent. The router portion of the notch may be placed with an angle in relation to the frame/partitions, or, as shown in the drawings, have an arcuate form. The notch 38 receives a pin 39 extending from the bottom side of the bottom member, which is guided in said notch, when the carriage means 31 is withdrawn from the frame, in order to displace the bottom member 36 in a direction P" which, at least during the final phase of said withdrawal, deviates from the general direction in which the partitions extend.

During the displacing movement the bottom member 36 slides in guiding members 40 of the carriage means 31.

When documents, letters or the like are to be sorted, these are placed in the respective compartment, in accordance with the order in which they are to be distributed, in such a way that the lower edge of each document rest on the displacable bottom 6, 16, 26, 36 of the compartment. When all documents are sorted, they are to be arranged in bundles, in the same sorting order, then to be placed in a carriage, a post bag or similar for distribution to the adressees.

Due to the fact that the bottom of the sorting device is displacable in relation to the partitions, in a direction which deviates from the general direction in which said partitions extend, the documents will, during the displacing movement fall, in a controlled manner, in the same direction, after which they may be pushed together into bundles in correct order in an easy manner.

For the person skilled in the art it is, of course, an obvious constructive step, to interconnect a number of sorting devices, as shown in FIG. 7, said sorting devices, then, including means (not shown) for interconnection side by side or on top of each other.

Several embodiments of the invention are disclosed, which all share the common feature of mutual displacability of the bottom and the partitions in a direction which deviates from the general direction in which the partitions extend, through which displacing movement is achieved the controlled felling of the sorted documents in a common direction.

Concerning details it should be mentioned that the sorting device may be designed as a cabinet or a frame constitution, the partitions may be made from wood, metal or plastic plates or string elements, the device may be supported by a framework, rest on a shelf or on a table, on beams or rails, as deemed necessary or desirable. Further, the sorting device preferably has a surface layer with a suitable friction coefficient in order to prevent the lower edges of the documents from sliding during the withdrawing movement, and may for example be coated with a layer of a cellular plastic material.

What is claimed is:

1. Device for sorting documents, comprising:

a number of compartments arranged substantially parallel and vertical in a frame in which compartment documents are placed standing up, said compartments being delimited by means of partitions which at their inner vertical sides are connected to elements forming part of the frame, said partitions being generally aligned in a general direction, said compartments having a bottom support structure on which documents rest, said bottom support structure being displaceable in relation to the partitions between a first position and a second position, in the first position said bottom support structure supporting the documents in a generally upright manner, and in the second position, with said bottom support structure movably extended away from the partitions in a direction which in a horizontal plane deviates from the general direction in which said partitions extend, said bottom support structure supporting the documents in a generally horizontally stacked manner, said documents engaging the partitions to provide a controlled fall movement of the documents as the bottom support structure is extended away from the partitions from the first position to the second position, said controlled fall movement resulting in the documents being provided in a generally horizontally stacked relationship when the bottom support structure is in the second position.

2. The device of claim 1, characterized in that the bottom support structure is slidably arranged in the frame and displaceable in a direction which deviates from the general direction in which the partitions extend.

3. The device of claim 1, characterized in that the partitions are slidably arranged in the frame and displaceable in a direction which deviates from the general direction in which the partitions extend.

4. The device of claim 1, characterized in that the partitions are arranged with an angle in relation to the frame, the bottom support structure being displaceable in a rectilinear direction in relation to the frame, when seen in a horizontal plane.

5. The device of claim 1, characterized in that the partitions are arranged with right angles in relation to the frame, the bottom support structure being displaceable in an oblique direction, when seen in a horizontal plane.

6. The device of claim 1, characterized in that the bottom support structure is displaceably arranged on a carriage means, said carriage means being supported and guided for rectilinear movement in relation to the frame and has means for simultaneous displacement of the bottom support structure in a direction which deviates from the general direction in which the partitions extend, when seen in a horizontal plane.

7. The device of claim 1, characterized in that an upper side of the bottom of the compartments has a layer of material of sufficient friction for supporting the documents in an upright manner when the bottom is in the first position.

8. The device of claim 5, characterized in that the bottom support structure is displaceable arranged on a carriage means, said carriage means being supported and guided for rectilinear movement in relation to the frame and has means for simultaneous displacement of the bottom support structure in a direction which deviates from the general direction in which the partitions extend, when seen in a horizontal plane.

9. A device for sorting articles comprising:

a frame;

a plurality of generally planar partition elements, said partition elements being generally aligned in a predetermined direction;

a plurality of compartments into which articles are placed in a generally upright manner, each of said plurality of compartments being at least partially defined between a pair of partition elements; and a support structure being movably coupled to the frame, said support structure having at least a pair of positions relative to the plurality of partition elements, in a first position said support structure supporting the articles in the generally upright manner, and in a second position with said support structure movably extended away from the partition elements in a direction deviating from the predetermined direction said support structure supporting the articles in a generally horizontal manner, said support structure and plurality of partition elements cooperating to provide a controlled movement of the articles as the support structure is extended away from the partition elements from the first position to the second position, said controlled movement resulting in the articles being provided in a generally stacked relationship when the support structure is in the second position.

10. A device according to claim 9, wherein at least one of the plurality of partition elements has a front portion and a rear portion, and said at least one of the plurality of partition elements is coupled to the frame proximate the rear portion.

11. A device according to claim 9, wherein the support structure is a displaceable lower structure having a generally planar surface and being slidably movable relative to the frame.

12. The device of claim 9, wherein an upper side of the support structure has a layer of material of sufficient friction for supporting the articles in an upright manner when the support structure is in the first position.

13. A device according to claim 10, wherein the front portion of the at least one of the plurality of partition elements is unrestrained.

14. A device for sorting articles comprising:

a frame;

a plurality of generally planar partition elements supported upon the frame;

a plurality of compartments into which articles are placed in a generally upright manner, each of said plurality of compartments being at least partially defined between a pair of partition elements; and a support structure being movably coupled to the frame and being movably extendible away from the partition elements between a first position and a second position, in the first position the support structure supports the articles in the generally upright manner, and in the second position with said support structure movably extended away from the partition elements in a direction deviating from the predetermined direction the support structure supporting the articles in a generally horizontal manner, said articles engaging the partition elements as the support structure is extended away from the partition elements from the first position to the second position resulting in the articles being provided in a generally stacked relationship when the support structure is in the second position.

15. A device according to claim 14, wherein the plurality of partition elements are provided in generally parallel alignment and are directed in a predetermined direction.

16. A device according to claim 15, wherein the support structure is a displaceable lower structure having a generally planar surface for supporting the articles, said displaceable lower structure being obliquely extendible from the partition elements with reference to the predetermined direction.

17. The device of claim 14, wherein an upper side of the support structure has a layer of material of sufficient friction for supporting the articles in an upright manner when the support structure is in the first position.

* * * * *